US008568049B2

(12) United States Patent
Kulik

(10) Patent No.: US 8,568,049 B2
(45) Date of Patent: Oct. 29, 2013

(54) MASCARA BRUSH WITH EYELASH RETAINING MEMBER

(75) Inventor: Daniela Kulik, Feuchtwangen (DE)

(73) Assignee: GEKA GmbH, Bechhofen (DE)

( * ) Notice: Subject to any disclaimer, the term of this patent is extended or adjusted under 35 U.S.C. 154(b) by 305 days.

(21) Appl. No.: 12/976,780

(22) Filed: Dec. 22, 2010

(65) Prior Publication Data

US 2011/0229246 A1 Sep. 22, 2011

Related U.S. Application Data

(60) Provisional application No. 61/314,453, filed on Mar. 16, 2010.

(51) Int. Cl.
*A46B 11/00* (2006.01)

(52) U.S. Cl.
USPC ..... 401/129; 401/126

(58) Field of Classification Search
USPC ..... 401/126–129; 132/218
See application file for complete search history.

(56) References Cited

U.S. PATENT DOCUMENTS

| | | | | |
|---|---|---|---|---|
| 4,561,456 | A | 12/1985 | Gueret | |
| 5,063,947 | A * | 11/1991 | Gueret | 132/218 |
| 5,345,644 | A * | 9/1994 | Gueret | 15/160 |
| 6,343,607 | B1 * | 2/2002 | Gueret | 132/218 |
| 6,412,496 | B1 * | 7/2002 | Gueret | 132/218 |
| 6,450,177 | B1 * | 9/2002 | Christoforu et al. | 132/218 |
| 6,581,610 | B1 * | 6/2003 | Gueret | 132/218 |
| 6,669,389 | B2 * | 12/2003 | Gueret | 401/122 |
| 7,125,188 | B2 * | 10/2006 | Gueret | 401/129 |
| 7,654,270 | B2 * | 2/2010 | Gueret | 132/200 |
| 7,789,094 | B2 * | 9/2010 | Gueret | 132/218 |
| 2002/0182409 | A1 * | 12/2002 | Gueret | 428/364 |
| 2004/0011375 | A1 | 1/2004 | Dumler | |
| 2005/0150509 | A1 | 7/2005 | Gueret | |
| 2006/0279181 | A1 | 12/2006 | Gueret | |
| 2007/0256700 | A1 | 11/2007 | Bodelin | |
| 2008/0219748 | A1 * | 9/2008 | Salciarini | 401/129 |
| 2008/0283078 | A1 | 11/2008 | Dumler et al. | |
| 2010/0083979 | A1 * | 4/2010 | Kim | 132/218 |

FOREIGN PATENT DOCUMENTS

| | | | |
|---|---|---|---|
| DE | 3218800 | C2 | 12/1982 |
| DE | 69105092 | T2 | 6/1995 |
| DE | 3933990 | C5 | 12/1999 |
| EP | 0568400 | A1 | 11/1993 |
| EP | 1462023 | A1 | 9/2004 |
| EP | 1611817 | A1 | 1/2006 |
| JP | 2003079427 | A | 3/2003 |
| WO | 2006124228 | A1 | 11/2006 |

* cited by examiner

*Primary Examiner* — David Walczak
*Assistant Examiner* — Jennifer C Chiang
(74) *Attorney, Agent, or Firm* — Setter Roche LLP

(57) ABSTRACT

The invention relates to a mascara brush comprising a carrier portion and a bristle covering of bristles respectively protruding outwardly along their longitudinal bristle axis L from the carrier portion, wherein the bristle covering comprises bristles consisting essentially of a bristle stem and an eyelash retaining organ adjoining thereto, which is configured as a retaining projection which projects over the surface of the bristle stem located, viewed in the direction of the longitudinal bristle axis, proximally-below it, in a direction transverse to the direction of the longitudinal bristle axis, or which is configured as a retaining groove open towards the distal end in the end face of the distal end of a bristle.

19 Claims, 11 Drawing Sheets

L
A
13
S
4
1
2

7
S
4
A (24:1)
S
4
7
13
L
3
13

13
13
L
1
2
5

13
13
3
4

MASCARA BRUSH WITH EYELASH RETAINING MEMBER

CROSS REFERENCE TO RELATED APPLICATIONS

This application claims the benefit of U.S. Provisional Application No. 61/314,453 filed Mar. 16, 2010.

FIELD OF THE INVENTION

The invention relates to a mascara brush for applying mascara onto the eyelashes.

BACKGROUND OF THE INVENTION

Such brushes are subject to a variety of requirements. Not only are they supposed to be capable of applying mascara as efficiently as possible, that is, in one stroke, if possible, without having to dip the mascara brush several times. Rather, they are also supposed to make it possible to curve the eyelashes in the sense of an upward curve (at the upper eyelid) or a downward curve (at the lower eyelid)—a treatment of the eyelashes referred to as "curling".

Moreover, they are also supposed to be capable of exerting certain tensile forces on the eyelashes so that they are visually extended, which is also referred to by the term "extending/lengthening".

Countless variations of mascara brushes have been proposed in the prior art which meet these requirements with different degrees of priority. In these cases, the focal point was so far directed primarily to finding a bristle covering whose bristles, depending on their specific diameter and their specific hardness, have exactly those different lengths that are optimal for reaching a good compromise in meeting the above-mentioned requirements.

Moreover, experiments with various bristle spacings were always carried out while trying to reach a good compromise in meeting the above-mentioned requirements.

Furthermore, the use of disc-shaped, rib-shaped or fin-shaped bodies that have a diameter considerably smaller than their length instead of conventional bristles was also already taken into consideration. However, the use of such massive bodies whose volume respectively exceed the volume of a single conventional bristle by several times also did not result in any decisive improvement, in particular also because the eyelashes are not distributed very well between these few large bodies which then constitute the bristle area, so that there is no sufficient separation.

Finally, it has also been proposed in practice that additional clamping organs separate from the bristles be used, which press the eyelashes from the outside against or onto the bristles, thus making it possible to grip the eyelashes in a plier-like manner for the purpose of curling or extending/lengthening in order to curve them or to more or less extend them in a desired manner.

SUMMARY OF THE INVENTION

The invention is based on the object of providing a mascara brush that is particularly suitable for curling and extending/lengthening.

The invention thus lies in the fact that the bristle covering comprises bristles consisting of a bristle stem and an eyelash retaining organ adjoining it within the bristle, so that a bristle with an integrated (and mostly integrally molded-on) eyelash retaining organ is provided. This eyelash retaining organ is configured as a retaining projection, which protrudes over the surface of the bristle stem, which is located—as viewed in the direction of the longitudinal bristle axis determined by the bristle stem—proximally-below it, in at least one direction transverse to the direction of the longitudinal bristle axis, preferably over the entire length of the bristle stem from its base point to the area where the eyelash retaining organ begins. A retaining groove that is incorporated into the distal end of the bristle and open towards the distal end and towards the flanks of the bristle is used as an equivalent according to the invention. In other words, it can be said that the eyelash retaining organ in the form of a retaining projection is configured as a thickened portion on an otherwise, as a rule, conventional, slim bristle, i.e. a bristle which has a substantially rod-shaped form. This thickened portion is preferably located directly on the distal end of the bristle or in the upper third of the bristle adjoining the distal end of the bristle. In this case, as was already indicated, a conventional slim bristle is understood to be a structure, which, with regard to its geometry, is elongated and bar-like and whose largest mean diameter is preferably smaller by a factor of 10 than its length.

The function of the eyelash retaining organ can be envisaged as follows:

When the mascara brush is used, the individual eyelashes penetrate into the bristle covering and thus come to lie in the free spaces of the bristle covering between the individual bristles.

If one now rotates the brush, for example in order to achieve a curling effect, then the eyelashes are bent, since they are at first somewhat retained in the intermediate spaces between the bristles, already by the adhesive effect of the mascara mass. The stronger the bent forced upon the eyelashes, the stronger the tendency which the eyelashes exhibit to overcome the adhesive effect of the mascara mass and slide off the bristle, that is, to glide along the bristles towards their distal end. Having arrived there, the eyelashes "snap" out of the bristle area and cannot be subjected to curling any longer.

The eyelash retaining organs according to the invention counteract this tendency. The most important point is that the eyelash retaining organs form a type of projection which an eyelash sliding along the bristle stem can overcome only by changing its direction of movement more than only inconsiderably, which, however, impedes the eyelash sliding off on the bristle. Ideally, the eyelash retaining organ is configured such that it forms a real positive obstacle for an eyelash that has come to rest on it, in the sense that the eyelash comes to rest on a surface of the eyelash retaining organ which is at least substantially oriented perpendicular to the longitudinal axis of the bristle or which even forms a local depression viewed in the direction of the (potential) movement of the eyelash, into which the eyelash inserts itself, and which therefore virtually cannot be overcome by the forces that currently act upon the eyelash and which so far have moved it approximately parallel to the longitudinal axis of the bristle.

However, the eyelash retaining organ does not mandatorily have to be designed such that it comprises said vertical surface or depression—taking into consideration the retaining action of the mascara mass accumulating in the area of the eyelash retaining organ, it is found that a less abrupt obstacle does indeed suffice. This is due to the fact that it is of primary importance that a perceptible change of direction is forced on the eyelash, which together with the retaining action of the mascara mass is sufficient for preventing the eyelash from further sliding off the bristle.

In this context, it should be noted that a merely local constricted portion or groove in a bristle does not constitute a sufficient eyelash retaining organ since such a constricted portion or groove is filled with mascara mass during application and can therefore be easily overcome by an eyelash gliding along a bristle towards the outside, towards its distal end. As a rule, such bristles which in the area of their distal end are merely curved or bent without any stabilizing thickened portion being provided (or in which a configuration is dispensed with in which the diameter of the bristle is reduced constantly towards its distal end) also do not constitute a bristle with an eyelash retaining organ within the sense of the invention. This also applies to bristles that are split into a tuft of individual filaments on their distal end. Such a tuft is so soft that it does not have any retaining action.

In the context of a preferred embodiment, it is provided that the respective eyelash retaining organ consists of at least one hook-like appendage protruding from the bristle stem. It is clear that such a hook-like appendage into which an eyelash sliding along the bristle stem "inserts itself", as it were, constitutes a particularly effective eyelash retaining organ.

If this is put into general terms, it could be said that the preferred eyelash retaining organ proximally has a surface which is at least locally inclined towards the bristle center, such that is has the tendency to let eyelashes that move towards the distal end of the bristle slide in a lateral direction towards the bristle center and thus capture them, which cancels the tendency of the eyelash to evade the eyelash retaining organ laterally.

In the context of a different embodiment, it is provided that the respective eyelash retaining organ consists of a ball-like, lenticular, disc-shaped or mushroom-cap-shaped thickened portion and preferably is rotationally symmetric to the longitudinal axis of the bristle. Such thickened portions can be easily produced, for example during the production of the bristle in an injection molding process.

In particular the embodiment of the ball-like thickened portion is an example for the fact already addressed above, namely that, at least in conjunction with the retaining action of the mascara mass, a less abrupt surface than a surface that is substantially perpendicular to the longitudinal bristle axis may also suffice for "stopping" the eyelash.

Preferably, the eyelash retaining organ distally has a surface which, from the area of the eyelash retaining organ lying above the bristle center towards the edges of the eyelash retaining organ, is inclined inwardly, towards the center of the mascara brush, such that this surface has the tendency to let eyelashes resting on it slide off in the intermediate space formed with the adjacent bristle(s). Thus, the surface of the eyelash retaining organ facing towards the outside is designed such that it guides the eyelashes into the intermediate spaces between the bristles when the mascara brush is first put up against the curve of the eyelashes.

In the context of another preferred embodiment, it is provided that the placement and the repeat of the adjacent bristle rows of bristles disposed one behind the other in the longitudinal direction are selected such that one bristle of a first bristle row, respectively, is placed on the level of a meridian, which (preferably centrally viewed in the longitudinal direction) extends through the free space that the eyelash retaining organs of two adjacent bristles of the neighboring bristle row leave blank between each other.

In this case, the eyelash retaining organs have such a large maximum extension, in the direction transverse to the circumferential direction, that the eyelash retaining organs of the bristles of said first bristle row—projected in the circumferential direction—overlap with the eyelash retaining organ of the two bristles closest to them of said second bristle row. It is thus ensured that, seen from the outside, no free space that is completely continuous in the radial direction and circular in the circumferential direction remains between two bristle rows. Instead, such a free space as a rule only remains between the bristle stems, underneath the surface of the brush which substantially presents itself as a labyrinth.

This makes it more difficult for the eyelashes, once they have penetrated into the remaining free space between two bristle rows, to slip out again from this free space.

Other configuration possibilities, advantages and modes of action which, if applicable, are to be made the subject matter of dependent claims, will become clear with reference to the following description of the Figures for the different exemplary embodiments.

BRIEF DESCRIPTION OF THE DRAWINGS

Generally, it should be noted with regard to the Figures that the Figure indicated by the letter b shows an enlarged detailed section of the Figure indicated by the letter c of the same number.

DETAILED DESCRIPTION OF THE PREFERRED EMBODIMENTS

First Exemplary Embodiment

Figures 1A, 1B, 1C, 1D, 1E:
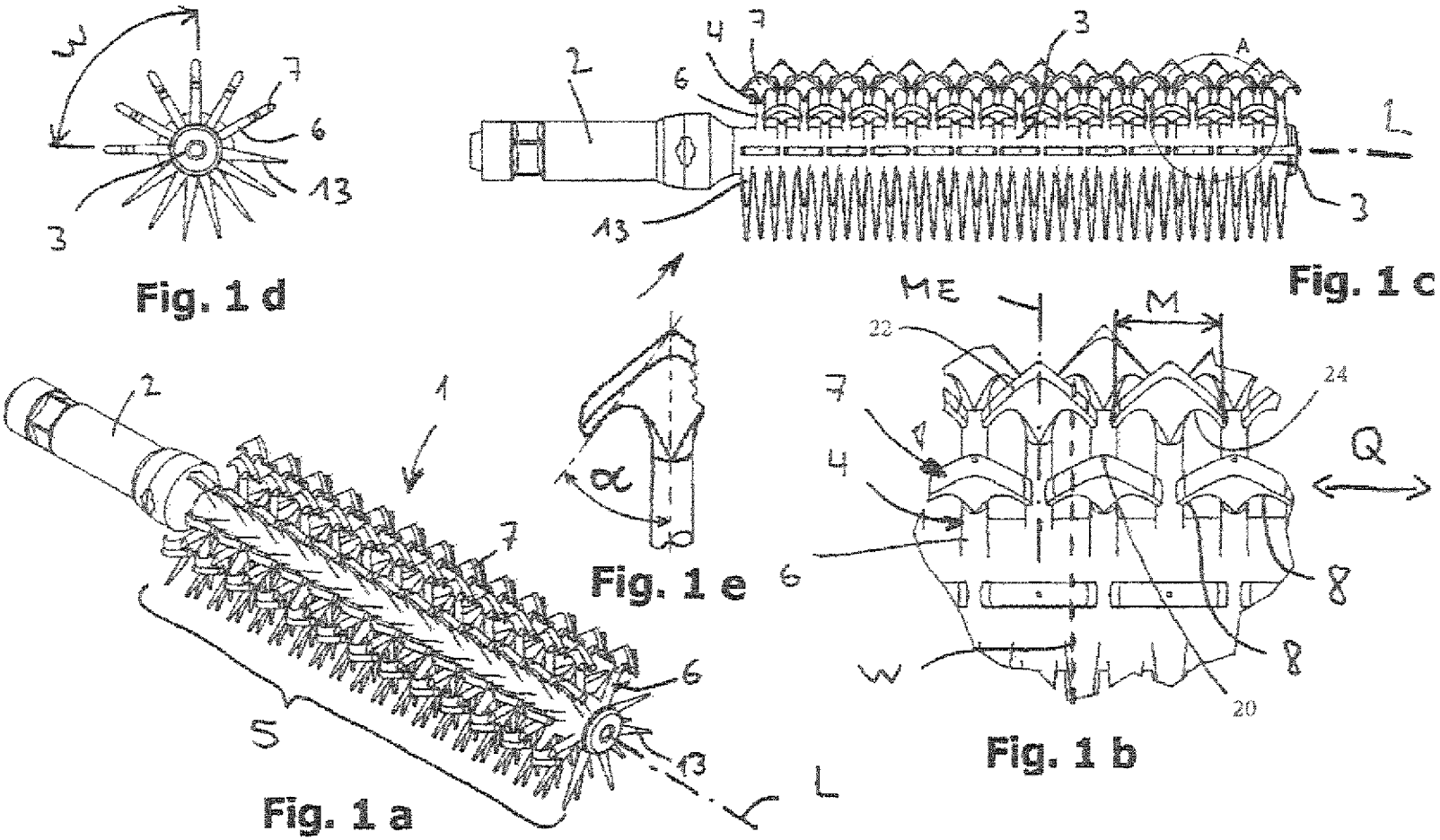
FIGS. 1*a* to 1*e* show a first exemplary embodiment of the invention, in which the eyelash retaining organs are configured in the form of arrow-shaped barbs.
Figure 2C:
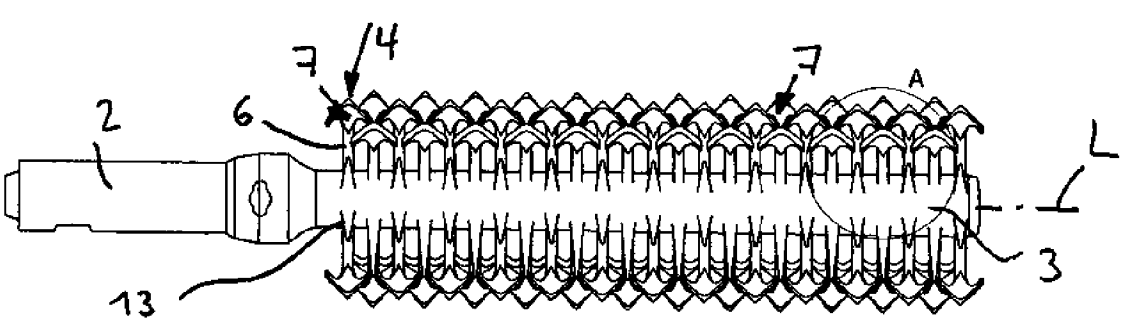
FIGS. 2*a* to 2*d* show a second exemplary embodiment of the invention, in which the eyelash retaining organs are configured in the form of arrow-shaped barbs, but are placed differently.
Figure 2B:
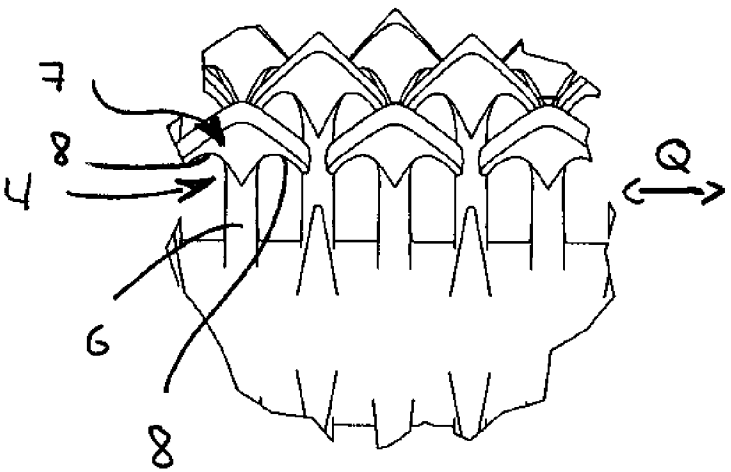
Figure 2D:
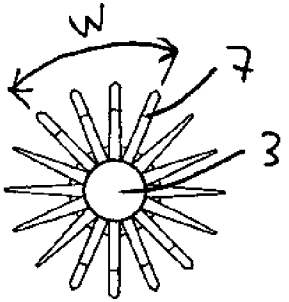
Figure 2A:
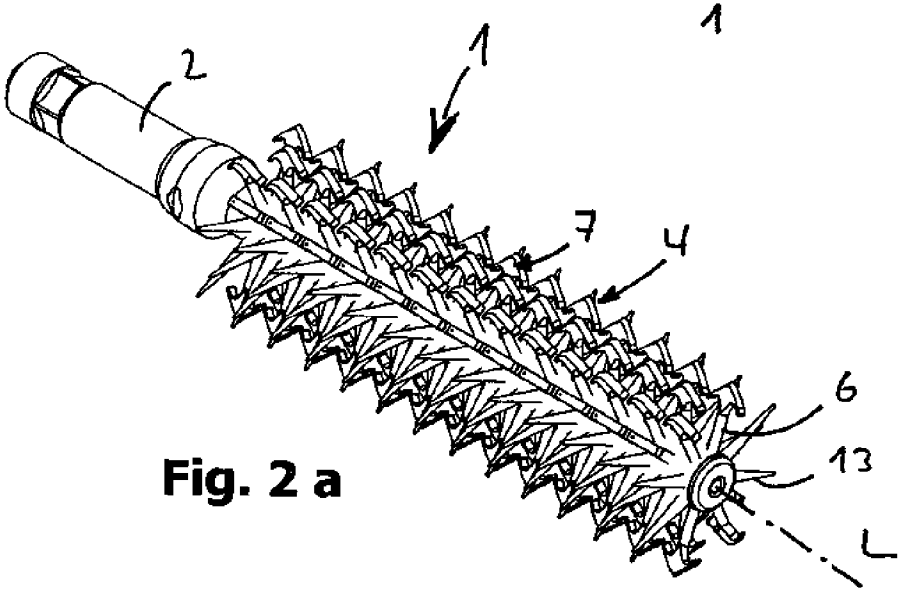

FIG. 1 shows a first exemplary embodiment of the invention.

The actual bristle body 1 of a mascara brush can be seen. The bristle body consists of a shoulder 2 for connecting the bristle body to the handle as well as of the rod-shaped bristle carrier 3. The bristle body forms a complete mascara brush only together with the shaft to be attached to the shoulder 2. The mascara brush of this exemplary embodiment has a pronounced longitudinal axis L, which at the same time constitutes the longitudinal axis of the bristle area. The bristle area can be called cylindrical or roller-shaped/conical (the latter is not shown herein).

The individual bristles 4 protrude in a substantially vertical direction from the bristle carrier 3 towards the outside and jointly form the bristle covering or bristle area 5. Their outermost end, which has the maximum distance from the bristle carrier 3, is referred to as the distal end. Their end forming the base area, with which they are attached to the bristle carrier 3, is referred to as the proximal end.

As can be seen well in FIG. 1*a*, each bristle comprises a bristle stem 6 whose contour largely corresponds to the contour of a conventional bristle, which, however, comprises a cylindrical cross-section with a diameter that remains constant over the length. The cross-section of this stem is round in the present exemplary embodiments, but may also be elliptical or polygonal. The diameter of the stem in the case of the present exemplary embodiment is at least eight times smaller than the length of the stem.

As can best be seen in FIG. 1*a*, the bristle area 5 comprises a number of bristle rows located, viewed in the longitudinal direction, next to one another. They consist of bristles in which the bristle stem 6 carries an eyelash retaining organ 7 on its distal end. In this case, this eyelash retaining organ 7 consists of an appendage formed as a barb, the longitudinal axis of which includes, at the outermost end of the barb, an angle $\alpha$ of less than 70°, still better of less than 50°, with the longitudinal axis of the bristle stem, see FIGS. 1*b* and, in particular, 1*e*. The design of the eyelash retaining organ for the present exemplary embodiment can be described such that the eyelash retaining organ 7 consists of two mutually opposing hook-like appendages 8 of the kind described above, which protrude laterally from the bristle stem 6.

Not least because of this does the eyelash retaining organ 7 have the shape of an arrow in the present case, the arrow tip of which lies in a line with the longitudinal axis of the bristle and forms the distal end of the bristle, whereas the "broad side" of the arrow is oriented proximally, that is, faces the bristle stem.

This results in a remarkably rigid structure which can be loaded with mascara mass well and can serve excellently as an eyelash retaining organ 7.

An eyelash which in the vicinity of the bristle stem 6 moves towards its distal end, for example because the mascara brush is rotated for the purpose of curling, slips under the corresponding hook-like appendage 8 and is prevented by it from sliding out from the bristle area 5.

As can be seen well in FIG. 1*b*, each eyelash retaining organ 7 designed as a barb distally, that is, on its outward-facing side, has a distal surface 22 which is substantially inwardly inclined from the area of the eyelash retaining organ 7 located above the bristle center 20 towards the edges of the eyelash retaining organ. This inclination is configured such that it has the tendency of letting eyelashes resting thereon slide into the intermediate space formed together with the adjacent bristle or its eyelash retaining organ. The eyelash retaining organ 7 also has a proximal surface 24 that is inclined towards the bristle center 20, such that the eyelash retaining organ 7 has a tendency to let eyelashes resting on it slide off in a lateral direction towards the bristle center.

According to which pattern the bristles provided with the eyelash retaining organs 7 are placed within the bristle area can best be seen by viewing FIGS. 1*b* and 1*d* together.

The bristles are arranged such that the respective result is rows of bristles standing one behind the other in the longitudinal direction and, at the same time, rows of bristles standing one behind the other in the circumferential direction.

In this case, viewed in the longitudinal direction, a bristle row and its neighboring bristle rows on both sides, forming a corresponding repeat, are arranged such that the rows have the same repeat and are substantially respectively offset relative to one another by half a repeat. Thus, the bristles of the two adjacent bristle rows are respectively located in front of the gap that the eyelash retaining organs of adjacent bristles of the center bristle row leave blank, that is, the bristles of the two adjacent bristle rows are (relative to the longitudinal bristle axis) each positioned on the level of a meridian ME extending centrally through the free space between the eyelash retaining organs of bristles of the center bristle row standing next to each other.

At the same time, the maximum extension M of the eyelash retaining organ, in the longitudinal direction symbolized by the arrow Q, is so large that one eyelash retaining organ, respectively, overlaps with the closest retaining organs of the adjacent row, if projected onto each other in the circumferential direction.

It is thus ensured that, from the outside (in the radial direction), there are no annular channels that are continuous in the circumferential direction in the bristle area formed by the bristles with the eyelash retaining organs. Instead, such a free space remains only between the bristle stems. The bristle area thus formed therefore constitutes a kind of labyrinth which, on the one hand, separates the eyelashes very well at the beginning of the application (precisely because there are no readily externally accessible continuous channels in the circumferential direction in which the eyelashes come to rest in bundles), and which, on the other hand, retains in a sustained manner those eyelashes that have entered the intermediate spaces of the bristle area, i.e. the hook-like appendages 8 of the respective eyelash retaining organ alternately, from the left and from the right, reach over every eyelash that is located in the free space between the bristle stems 6 of adjacent bristle rows (as the dashed line W indicates) so that it is thus securely retained within the bristle area 5.

Eyelash retaining organs 7 that are functionally configured like those shown in FIGS. 1*a* to 1*d* thus perform their function by means of a real positive fit.

In principle, it may be expedient to equip all bristles forming the bristle area 5 with an eyelash retaining organ 7 according to the invention.

However, as FIG. 1*a* and FIG. 1*d* show, only a part of the bristle area extending over approximately one third of the circumference of the brush is equipped with such eyelash retaining organs while the rest of the bristle area is formed by conventional bristles. The mascara brush can thus be used more flexibly—depending on whether curling is to be performed, or whether the eyelashes are simply to be combed, the user turns the mascara brush such that either the conventional bristles or the bristles equipped with the eyelash retaining organs 7 interact with the eyelashes.

Specifically exemplary embodiments of the kind described herein, with arrow-shaped eyelash retaining means, have the great advantage that a considerable additional amount of mascara mass is deposited on the arrow-shaped structure without there being any risk of the mascara mass dripping off in an undesired manner, which enables a very effective application of the mascara mass without having to charge the mascara brush again several times.

Second Exemplary Embodiment

FIGS. 2*a* to 2*d* show a second exemplary embodiment which, with the exception of the following comments, completely corresponds to the first exemplary embodiment, so that the statements at the beginning apply here mutatis mutandis.

The two exemplary embodiments differ in the distance that the individual rows of the bristles equipped with the eyelash retaining organ 7 have. While four rows of bristles with eyelash retaining organs disposed one behind the other in the longitudinal direction "cover" an angle W of 90° in the first exemplary embodiment, four such rows, in the second exemplary embodiment, only cover an angle of 60°. In exchange, however, two opposite sections of the bristle area are provided with such bristles that comprise eyelash retaining organs, instead of with conventional bristles.

Third Exemplary Embodiment

FIGS. 3*a* to 3*d* disclose a third exemplary embodiment. With regard to its function, this third exemplary embodiment substantially corresponds to the first two exemplary embodiments mentioned, so that the statements pertaining thereto also apply to this exemplary embodiment to the extent that the comments below do not specify otherwise.

The essential difference to the two first exemplary embodiments is that, in this exemplary embodiment, the two hook-like appendages 8 are designed such that they can be elastically bent towards the lateral end of the bristle with relative ease, whereas in the case of being bent in the distal direction, they still offer a sufficiently large resistance so that their function as an eyelash retaining organ 7 is not challenged.

In this case, no specific instructions as to dimensions can be given here, since the dimensioning required for achieving the desired effect is very strongly dependent upon the individual case, namely on the geometry and curvature selected for the hook-like appendage 8 as well as on the material selected. However, once the material and the basic contour of the hook-like appendage are known, it can be relatively easily determined, by experiments common in the field, how dimensioning is to be carried out in individual cases in order to achieve the desired effect.

The resilience in the proximal direction mentioned makes it easier for the eyelashes to enter into the bristle area at the beginning of the application, while it does not perceptibly impair the retaining effect of the eyelash retaining organs 7.

The arrangement of the bristle rows consisting of conventional bristles and bristles with eyelash retaining organs relative to one another and their repeat constitutes another difference to the first two exemplary embodiments.

In this case, a row of bristles with eyelash retaining organs 7 extending in the longitudinal direction is flanked on both sides by a row of conventional bristles extending in the longitudinal direction. In one of these rows of conventional bristles, the repeat is selected such that one bristle, respectively, is located on the same level, seen in the circumferential direction, as one of the hook-like appendages 8. In the other row of conventional bristles, the repeat is designed such that one bristle is aligned, in the circumferential direction, with the bristle stem 6 (of one of the bristles equipped with the eyelash retaining organs 7), that is, lies on the meridian determined by this bristle stem 6, whereas the next conventional bristle in the longitudinal direction is aligned with the free space between the eyelash retaining organs of two adjacent bristles. This results in a bristle area which lets the eyelashes enter well and which offers a good retaining effect with regard to the eyelashes that have entered.

Figure 3C:
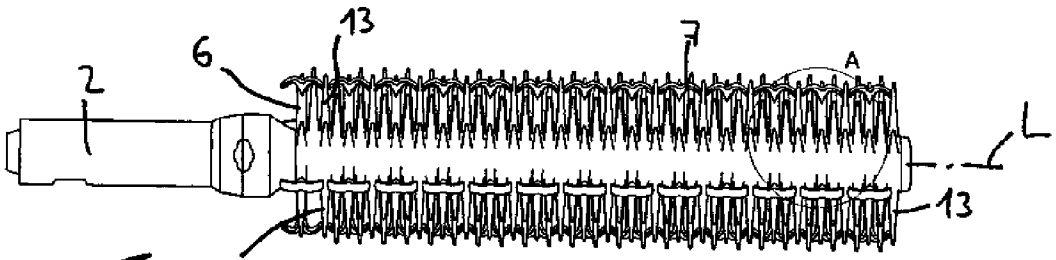
FIGS. 3*a* to 3*d* show a third exemplary embodiment of the invention, in which the eyelash retaining organs are configured in the form of anchor-shaped barbs.
Figure 3B:
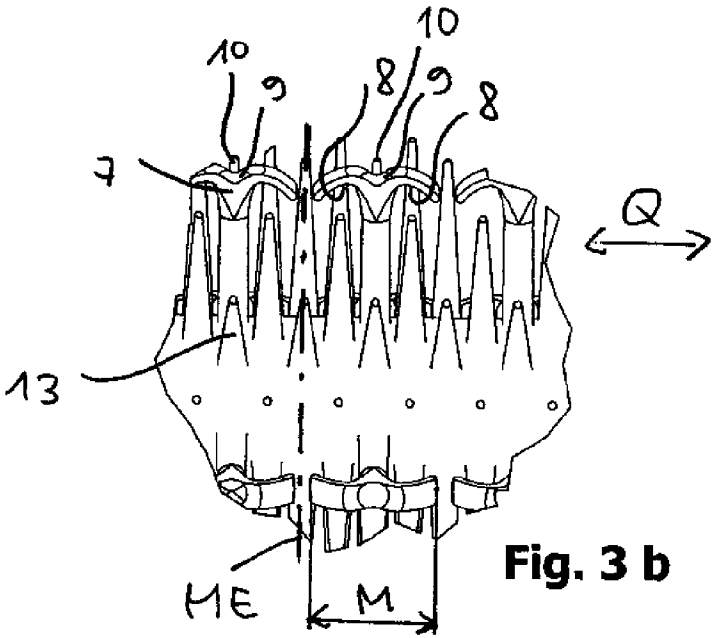
Figure 3D:
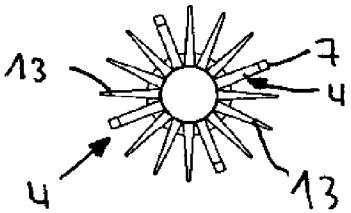
Figure 3A:
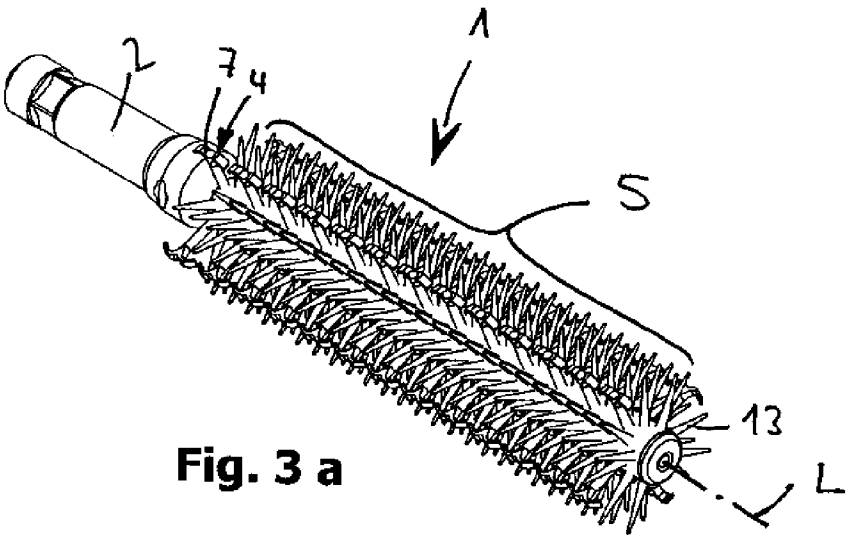

As can be seen in FIG. 3*d*, four bristle rows with eyelash retaining organ 7 extending in the longitudinal direction are provided at the circumference, which have a respective "distance" of 90°. This also enables the eyelashes to enter the bristle area more easily at the beginning of the application.

What is also remarkable is that the eyelash retaining organs in this exemplary embodiment are designed such that they have a depot for mascara mass on their distal surface.

To this end, the two hook-like appendages 8 are designed so that, where they meet, i.e. in the vicinity of the longitudinal bristle axis 6, they form a cavity 9 open at the flanks preferably in the circumferential direction in which mascara mass can deposit without being wiped off when the applicator is pulled out of the storage container. This unimpeded deposit of the mascara mass is in this case promoted by a pin 10 protruding distally from the cavity 9, the pin preventing the wiper from penetrating undesirably far into the cavity 9 protected by it and offering additional purchase to the deposited mascara mass, thus counteracting the mascara mass dripping off in an undesired manner under the influence of gravity and the drag of the eyelashes pulled through the mascara depot. The optional open-flank design makes it easier for the eyelashes, which are preferably oriented in the circumferential direction, to find access to the cavity and the mascara mass deposited there.

It is readily clear that the cavity described with reference to this particular exemplary embodiment is generally expedient, that is, is important not only for the exemplary embodiment specifically described here, but can also be used for differently configured eyelash retaining organs.

Fourth Exemplary Embodiment

FIGS. 4*a* to 4*d* show a fourth exemplary embodiment of the invention which almost completely corresponds to the third exemplary embodiment, so that the statements therefrom also apply in this case.

The sole difference between the third and fourth exemplary embodiments lies in their repeat, the number of the longitudinally extending rows of bristles with eyelash retaining organs and their distribution over the circumference. Moreover, the fourth exemplary embodiment lacks the useful extra of a pin 10.

Also in the case of the fourth exemplary embodiment, a row of bristles with eyelash retaining organs extending in the longitudinal direction is flanked on both sides by a row of conventional bristles extending in the longitudinal direction.

In this exemplary embodiment, however, the repeat and the arrangement of the bristle rows purely consisting of conventional bristles are selected such that one bristle, respectively, is located on the same level, seen in the circumferential direction, as one of the hook-like appendages 8, that is, on a meridian extending through this hook-like appendage 8.

In contrast to the third exemplary embodiment, there are therefore also channels in the bristle area of bristles with eyelash retaining organs 7 that are continuous in the circumferential direction as seen from the outside along the radial direction in this exemplary embodiment.

Figure 4C:
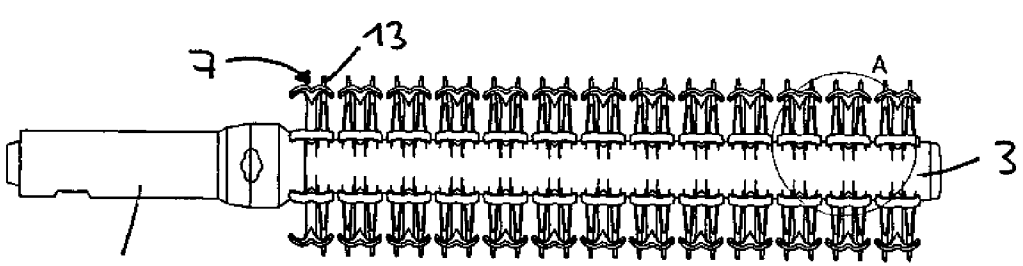
FIGS. 4*a* to 4*d* show a fourth exemplary embodiment of the invention, in which the eyelash retaining organs are configured in the form of anchor-shaped barbs, but are placed differently and are slightly modified.
Figure 4B:
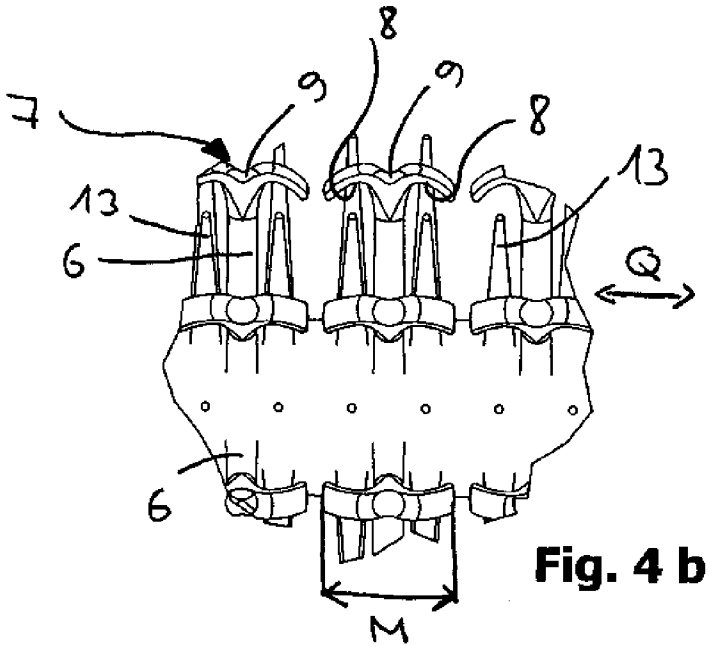
Figure 4D:
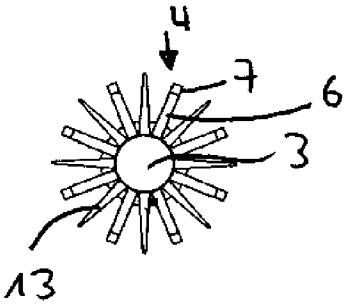
Figure 4A:
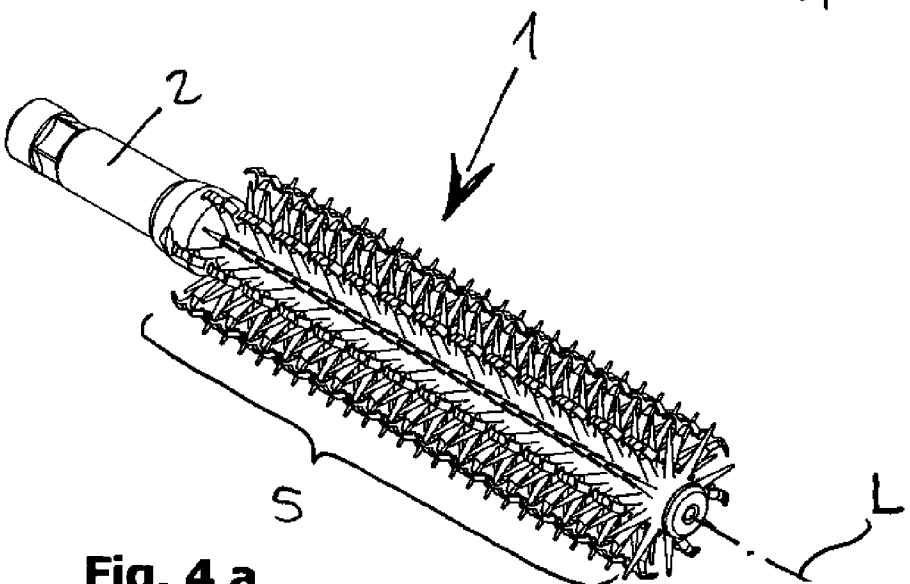

In exchange, seen in the circumferential direction, a row of bristles with eyelash retaining organs standing one behind the other in the longitudinal direction alternates with a row of conventional bristles standing one behind the other in the longitudinal direction, as can best be seen in FIG. 4*d*.

Fifth Exemplary Embodiment

FIGS. 5*a* to 5*d* show a fifth exemplary embodiment. The fifth exemplary embodiment partially corresponds to the above-described exemplary embodiments. Therefore, the statements concerning the above exemplary embodiments apply mutatis mutandis to this fifth exemplary embodiment unless otherwise stated below, or unless a difference clearly results from the function of the fifth exemplary embodiment.

In this fifth exemplary embodiment, the eyelash retaining organ 7 is configured as a ball-like thickened portion on the distal bristle end. The eyelash retaining organ 7 in this case forms a kind of projection. In contrast to the previously described exemplary embodiments, this projection, however, does not exert any actually positive retaining force within the generally accepted sense. However, the eyelash retaining organ forms a projection also in this case, which an eyelash sliding along the bristle stem towards the distal end of the bristle can only overcome by changing its direction. Since an increased amount of mascara mass having a not inconsiderable adhesive effect is located, even after wiping, on the ball-like thickened portion, which now serves as an eyelash retaining organ 7, the eyelash is incapable of readily overcoming the ball-like thickened portion even though an actual positive fit is lacking.

Figures 5A, 5B, 5C, 5D:
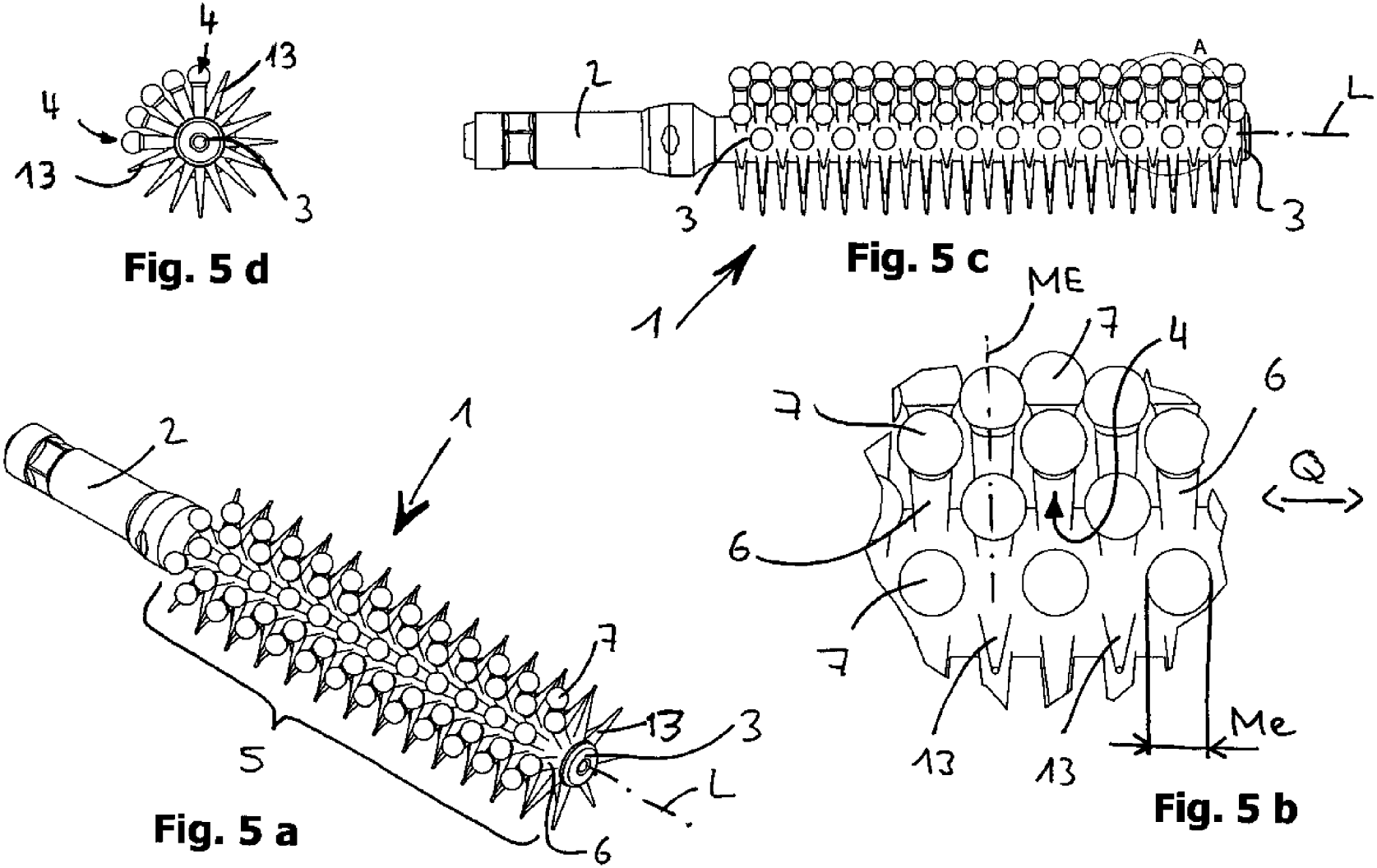
FIGS. 5*a* to 5*d* show a fifth exemplary embodiment of the invention, in which the eyelash retaining organs are configured in the form of ball-shaped thickened portions.

As the FIG. 5*b*, in particular, shows, the placement and the repeat of the individual bristle row of bristles standing one behind the other in the longitudinal direction is in this case selected such that the eyelash retaining organs 7 of the bristles of a first row lie with their center exactly on the meridian which extends through the center of the free space that the eyelash retaining organs of two bristles of the adjacent row standing beside each other leave blank between each other.

At the same time, the diameter of the ball-like thickened portions, and thus the maximum extension of the ball-like thickened portions in a direction transverse to the circumferential direction is selected to be so large that this eyelash retaining organ of said first bristle row, projected in the circumferential direction, completely covers the gap that the two eyelash retaining organs located next to each other of the neighboring second bristle row leave blank between each other.

As can best be seen in FIG. 5*d*, the area of the bristles with the eyelash retaining organs 7 extends over a fourth of the circumference of the brush. As was already stated above, the user can thus choose also in this case whether she currently desires to work with the area of conventional bristles or the area of the bristles with the eyelash retaining organs according to the invention.

For the sake of completeness, different variations of this exemplary embodiment must also be addressed within the context of this fifth exemplary embodiment, which have not been illustrated by drawings because they can be described sufficiently exactly in a purely verbal manner. Alternatively, the eyelash retaining organ, which in this fifth exemplary embodiment is designed in a ball shape, can also consist of a lenticular, disk-shaped or mushroom-cap shaped thickened portion. If their radius is large enough so that the thickened portion projects to a sufficient extent over the bristle stem carrying it, then such thickened portions also fulfill the eyelash-retaining function according to the invention. It applies to all variations of this fifth embodiment inclusive of the one shown in the Figures that the maximum diameter of the thickened portion should preferably be at least 1.5 times, better twice as large, as the diameter of the adjacent bristle stem.

Finally, referring to FIG. 5*d*, another variation of the fifth exemplary embodiment and its variations described here must be described. Depending on the case of use, it may be advantageous if a free area is left that is free from bristles or provided only with very much shortened bristles, over an angle of preferably 20 to 50 degrees, between the part of the bristle area consisting of bristles 4 with eyelash retaining means and the part of the bristle area consisting of conventional bristles 13—so that a brush of the type shown in FIG. 5*d* lacks in this variation the bristles marked in FIG. 5*d* with the reference numeral 13 or the associated bristle rows. It is thus made possible for the eyelashes to enter from the side the part of the bristle area consisting of bristles with eyelash retaining means, which facilitates the entry and the subsequent "retention" of the eyelashes.

Sixth Exemplary Embodiment

FIGS. 6*a* to 6*d* show a sixth exemplary embodiment. The sixth exemplary embodiment corresponds entirely to the fifth exemplary embodiment and differs therefrom only by the distribution of the various bristles on the circumference of the bristle carrier 3. Therefore, the statements pertaining to the fifth exemplary embodiment also apply mutatis mutandis to the sixth exemplary embodiment unless otherwise stated below.

In this sixth embodiment, a row of bristles with eyelash retaining organs standing one behind the other in the longitudinal direction is flanked on both sides by a row of conventional bristles. The arrangement and the repeat are selected such that the bristles of the conventional bristle row are disposed on a meridian which extends centrally through the free space that the eyelash retaining organs of two adjacent bristles of the neighboring row leave blank between each other.

Figure 6C:
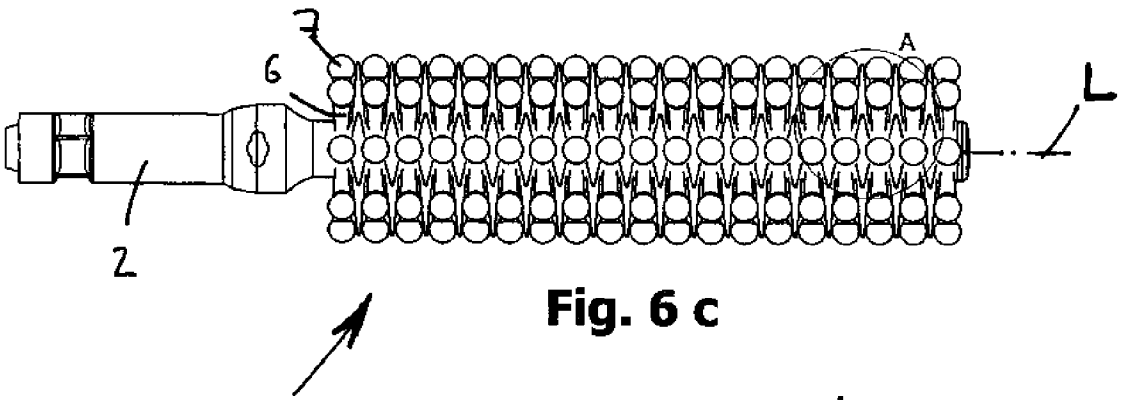
FIGS. 6*a* to 6*d* show a sixth exemplary embodiment of the invention, in which the eyelash retaining organs are configured in the form of ball-shaped thickened portions, but are placed differently.
Figure 6B:
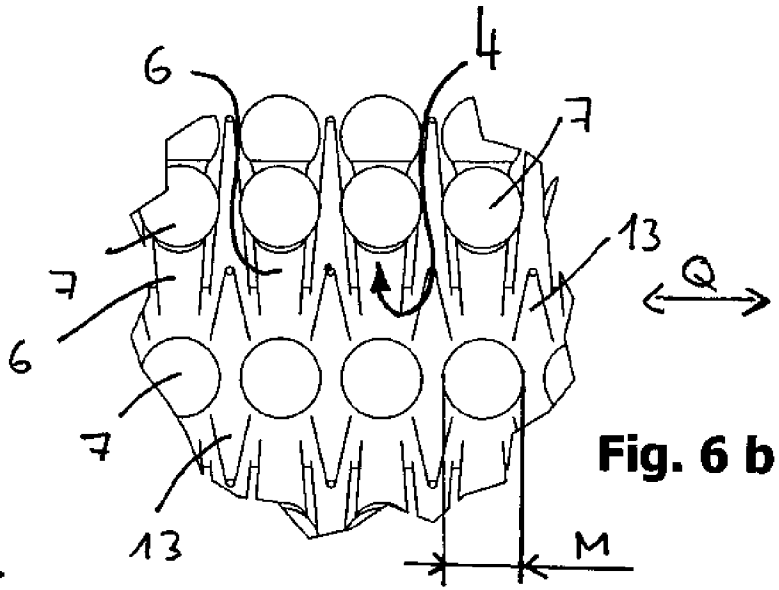
Figure 6D:
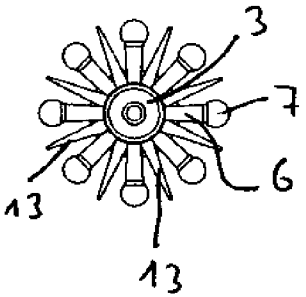
Figure 6A:
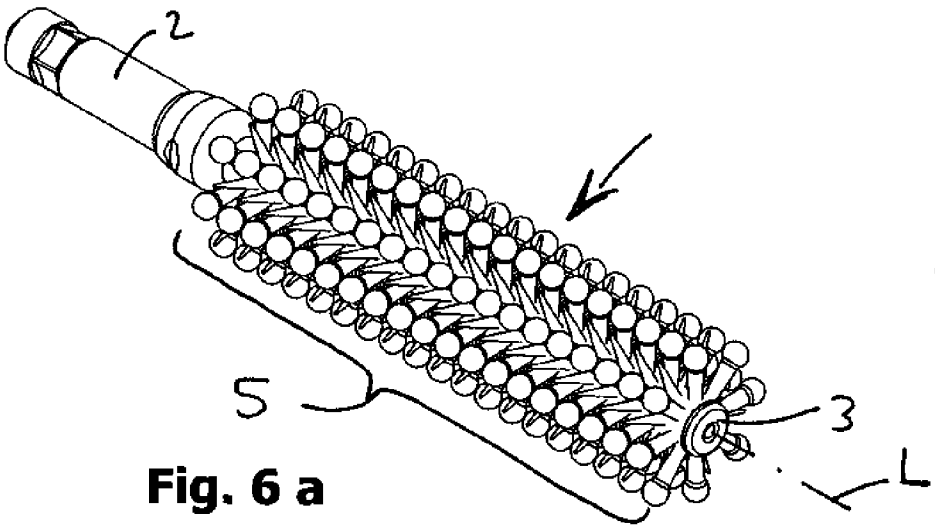

Preferably, an arrangement is furthermore selected as it is shown by FIG. 6*d*—one row of bristles with eyelash retaining organs and one row of conventional bristles always alternate over the circumference or at least a part of the circumference.

Seventh Exemplary Embodiment

FIGS. 7*a* to 7*d* show a seventh exemplary embodiment. The seventh exemplary embodiment follows a different concept from that of the previously described exemplary embodiment.

FIGS. 7*a* and 7*c* to 7*e* again show the actual bristle body 1 of a mascara brush. The bristle body, also in this case, consists of a shoulder 2 for connecting the bristle body to the handle as well as of the rod-shaped bristle carrier 3. The bristle body forms a complete mascara brush only together with the shaft to be attached to the shoulder 2.

Also in this case, the individual bristles 4 protrude substantially perpendicularly from the bristle carrier 3 towards the outside and together form the bristle covering 5.

Figures 7A, 7B, 7C, 7D, 7E:
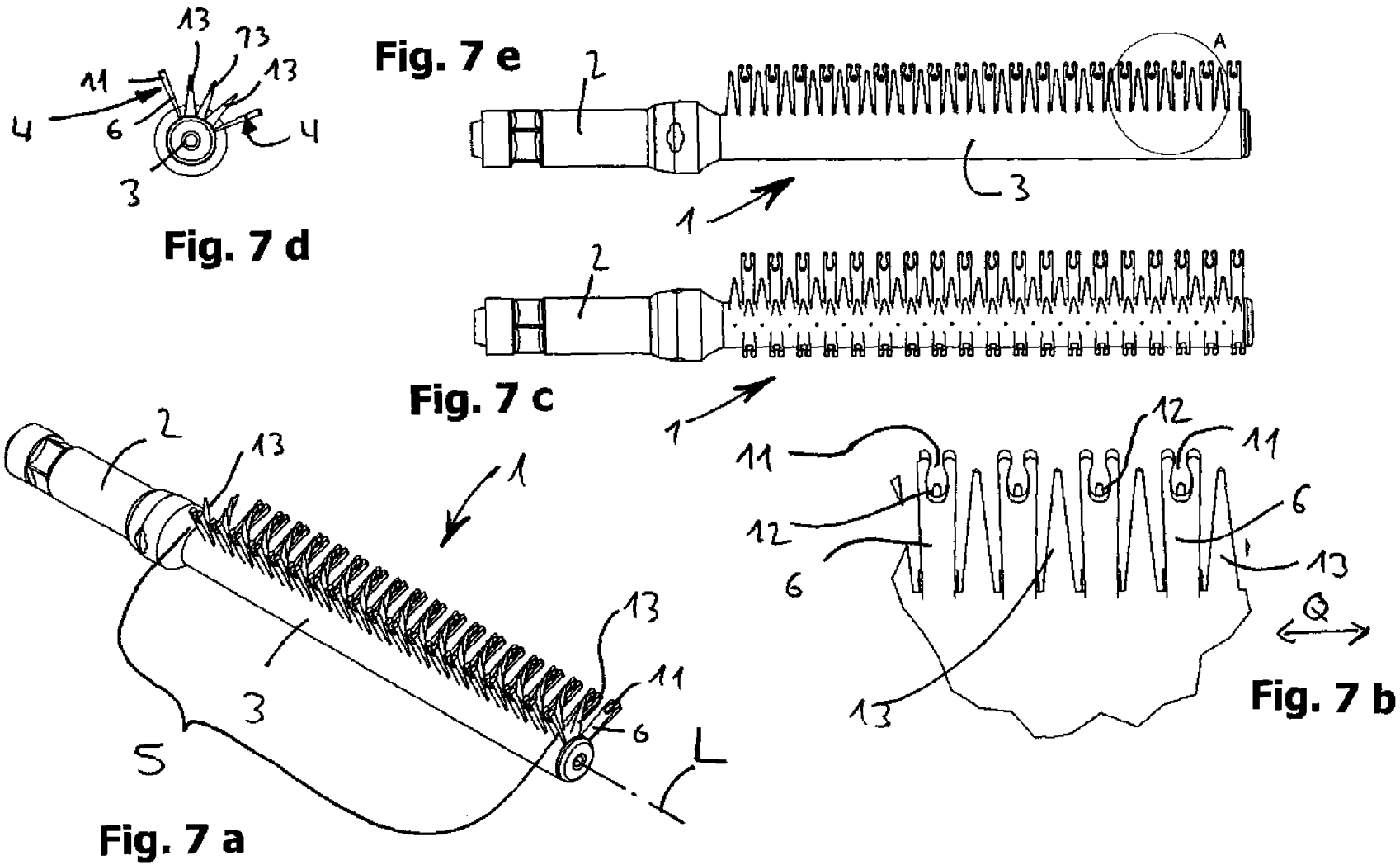
FIGS. 7*a* to 7*e* show a seventh exemplary embodiment of the invention, in which the eyelash retaining organs are configured in the form of retaining grooves on the end faces of the bristles.

As can be seen well in FIG. 7*a*, each bristle has a bristle stem 6, which in this case preferably has a rectangular cross section, but may theoretically also be round or elliptical, because its shape is not exclusively optimized with a view to the production costs for the mold. Preferably, the cross sectional area of the bristle stem 6 becomes larger towards the distal end so that the bristle becomes wider in the longitudinal direction. At the distal end of the bristle, a retaining groove 11 that is open towards the distal end and towards the sides of the bristle is formed into the end face of the distal end of the bristle.

In this case, the retaining groove 11 is designed such that its width viewed in the longitudinal direction becomes larger from the distally outermost end in the proximal direction. The retaining groove 11 thus receives a clamp-like or dovetail-like profile that exerts a retaining action on eyelashes that have inserted themselves into the retaining groove 11.

At the same time, the retaining groove serves as a generous reservoir on which the wiper has no influence, and in which, therefore, a considerable amount of mascara mass remains stored even after wiping the mascara brush. In this case, the retaining groove 11 at the same time offers enough purchase to the soft mascara mass stored therein that there is no danger of dripping—because the width of the retaining groove 11 (or the entire dimension of the retaining groove 11) is designed accordingly in the case of the present exemplary embodiment. The stored mascara mass considerably supports the retaining action of the retaining groove 11 but also makes the application of the mascara mass onto the eyelashes more effective, because the eyelashes are thus pulled through the considerable mascara volume stored in the retaining groove 11 in a guided manner and are thus coated specifically.

A chicane 12 which protrudes, from the groove bottom or the surface forming the boundary on the inside of the retaining groove, into the retaining groove and there is configured as a cylindrical pin is provided in the retaining groove, preferably in its groove bottom. This chicane can be provided for various purposes. As a rule, it serves for offering better purchase to the mascara mass stored in the area of the groove bottom so that there is less danger of the mascara mass running out from the groove bottom and dripping off in an undesired manner—in particular under the influence of the drag that an eyelash pulled through the groove exerts. Accordingly, the retaining groove is dimensioned so as to take account of the properties of the mascara mass; it is no problem for a person skilled in the art to determine the specific dimensioning for the individual case by experiments that are common in the field.

It can be seen rather well in FIGS. 7*a* to 7*e* how the individual rows of bristles standing one behind the other in the longitudinal direction are arranged and what repeat they have.

As can best be seen with reference to FIG. 7*c*, the repeat and the orientation are adapted to each other such that the bristles of a first conventional bristle row, which is adjacent to a bristle row with eyelash retaining organs, lie on a meridian which extends centrally through the free space between two adjacent bristles with eyelash retaining organs.

In contrast, a next second row with conventional bristles that itself follows the first row with conventional bristles is designed such that its bristles respectively lie on a meridian extending through the longitudinal axis of the bristles with the eyelash retaining organs.

In the present embodiment, the bristle carrier is only covered at all with a bristle area over a fourth of its circumference. In this case, it is the two rows of bristles with eyelash retaining organs standing one behind the other that form the boundary of the bristle area, so that no further bristle rows follow on its one side. It is thus easier for the user to thread the eyelashes in more than just a random manner into the retaining grooves 11 in which they are retained for the purpose of curling and in which they are at the same time coated particularly effectively with the mascara mass stored therein—which not least facilitates the extending/lengthening process.

Eighth Exemplary Embodiment

FIGS. 8*a* to 8*d* show an eighth exemplary embodiment. The eighth exemplary embodiment is substantially identical to the seventh exemplary embodiment, so that the statements pertaining thereto also apply to the eighth exemplary embodiment with the exception of the differences specified below.

Figures 8A, 8B, 8C, 8D, 8E:
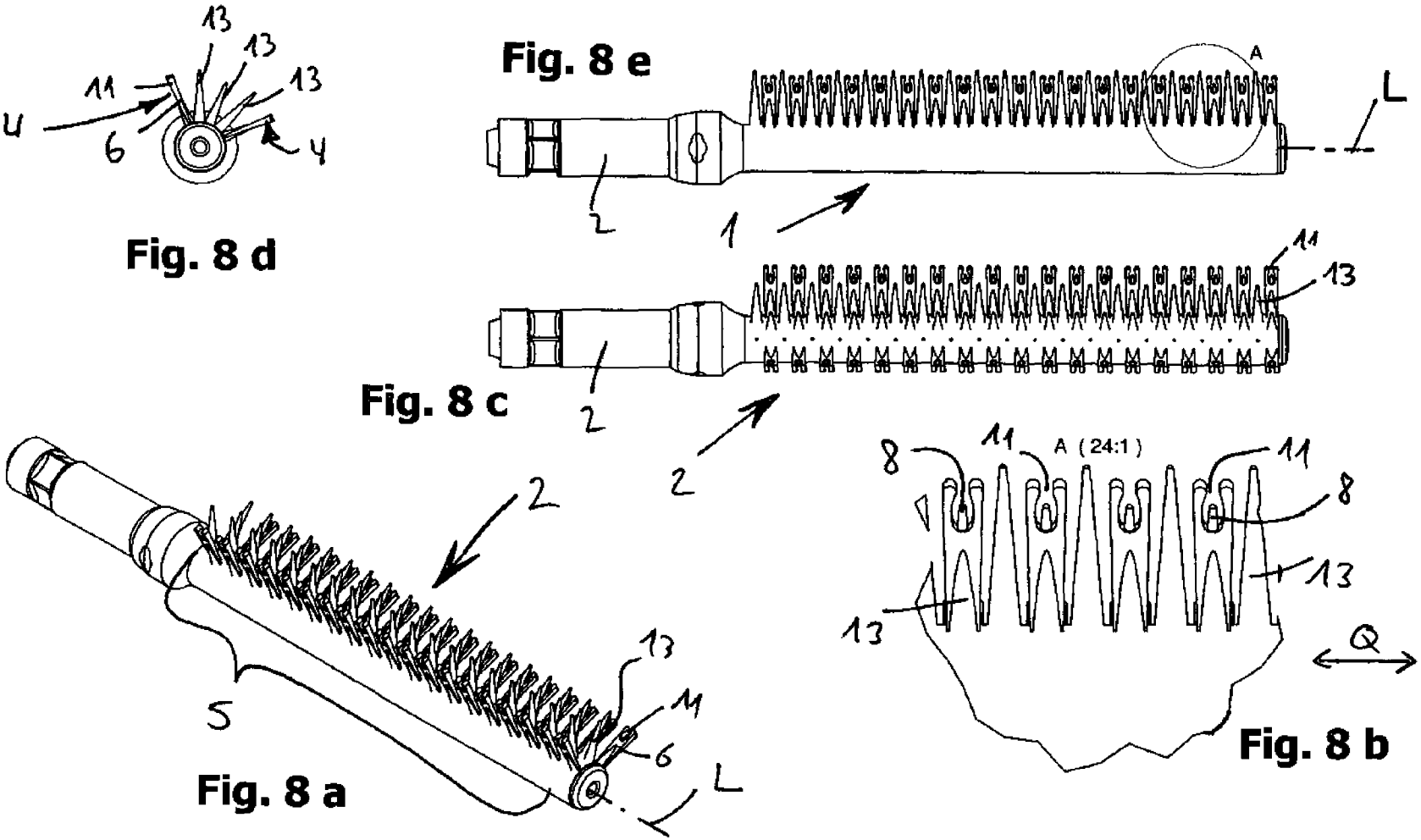
FIGS. 8*a* to 8*e* show an eighth exemplary embodiment of the invention, in which the eyelash retaining organs are configured in the form of retaining grooves on the end faces of the bristles, but are placed differently and are slightly modified.

As can be seen rather well with reference to FIG. 8*b*, the chicane 12 in this exemplary embodiment is dimensioned slightly more generously, which may for example be expedient if the mascara mass has a significantly more liquid consistency.

Moreover, the arrangement of the various bristle rows is chosen to be slightly different. In this case, a first row of conventional bristles is provided as a row adjacent to a bristle row of bristles with eyelash retaining organ, the conventional bristles being disposed such that they lie on a meridian extending through the longitudinal axis of an adjacent bristle with an eyelash retaining organ. This second row, which follows this first row of conventional bristles and also consists of conventional bristles, is designed such that its bristles respectively lie on a meridian which extends centrally through the free space between two adjacent bristles with an eyelash retaining organ.

With regard to the seventh and eighth exemplary embodiments, it may be remarked in a general manner, and thus also in the sense of the protection sought herein, that the eyelash retaining organs are in this case configured as a retaining means on the end face of the distal end of a bristle into which the eyelash concerned can be introduced, if required, by a rotational movement which introduces the eyelash coming here from the outside, obliquely to the longitudinal bristle axis, into the retaining means.

Moreover, it must be noted that the areas of the bristle that laterally form the boundary of the retaining groove 11 must of course be configured to be firm enough so as to be strong enough to ensure the retaining action and/or storing action for the mascara mass.

Ninth Exemplary Embodiment

FIGS. 9*a* to 9*d* show a ninth exemplary embodiment. The ninth exemplary embodiment is characterized by the fact that two bristles, respectively, have a joint eyelash retaining organ 7 configured such that it forms, together with the bristles concerned, an opening 26, which is substantially closed on all sides in a single plane, into which at least one eyelash can be threaded. In this case, the eyelash retaining organ could also be boldly described such that it forms, at least substantially, a needle eye intended for threading in an eyelash. The eyelashes could more or less slide into the needle eye and are then coated with mascara on all sides; an "embracing" bristle or bristle arrangement is obtained, as it were. Preferably, the eyelash retaining organ in this case has a rod-shaped shape with, ideally, a circular cross-section.

Figures 9A, 9B, 9C, 9D:
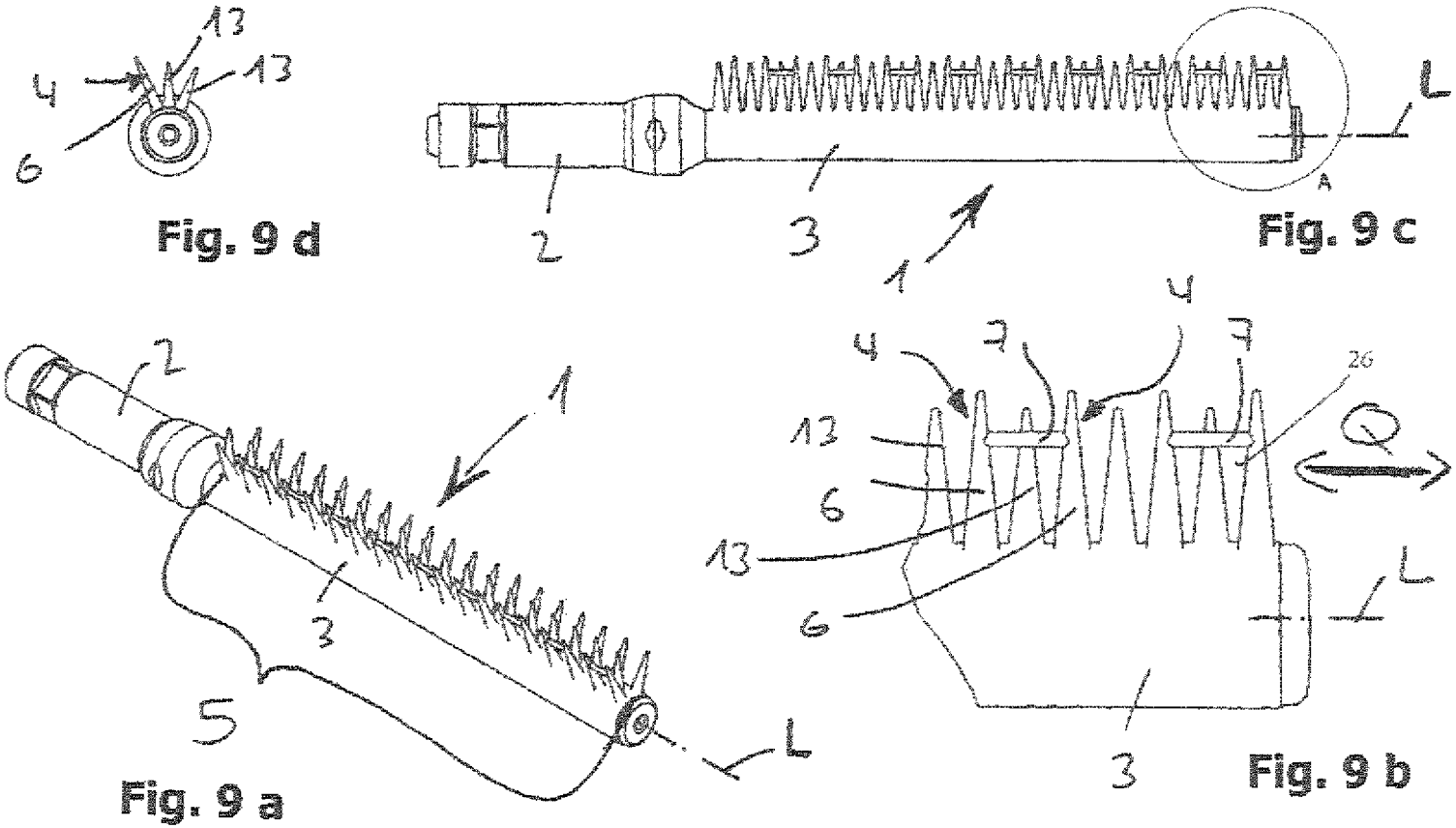
FIGS. 9*a* to 9*d* show a ninth exemplary embodiment of the invention, in which the eyelash retaining organs are configured in the form of a needle eye or a gate.
Figures 10A, 10B, 10C, 10D:
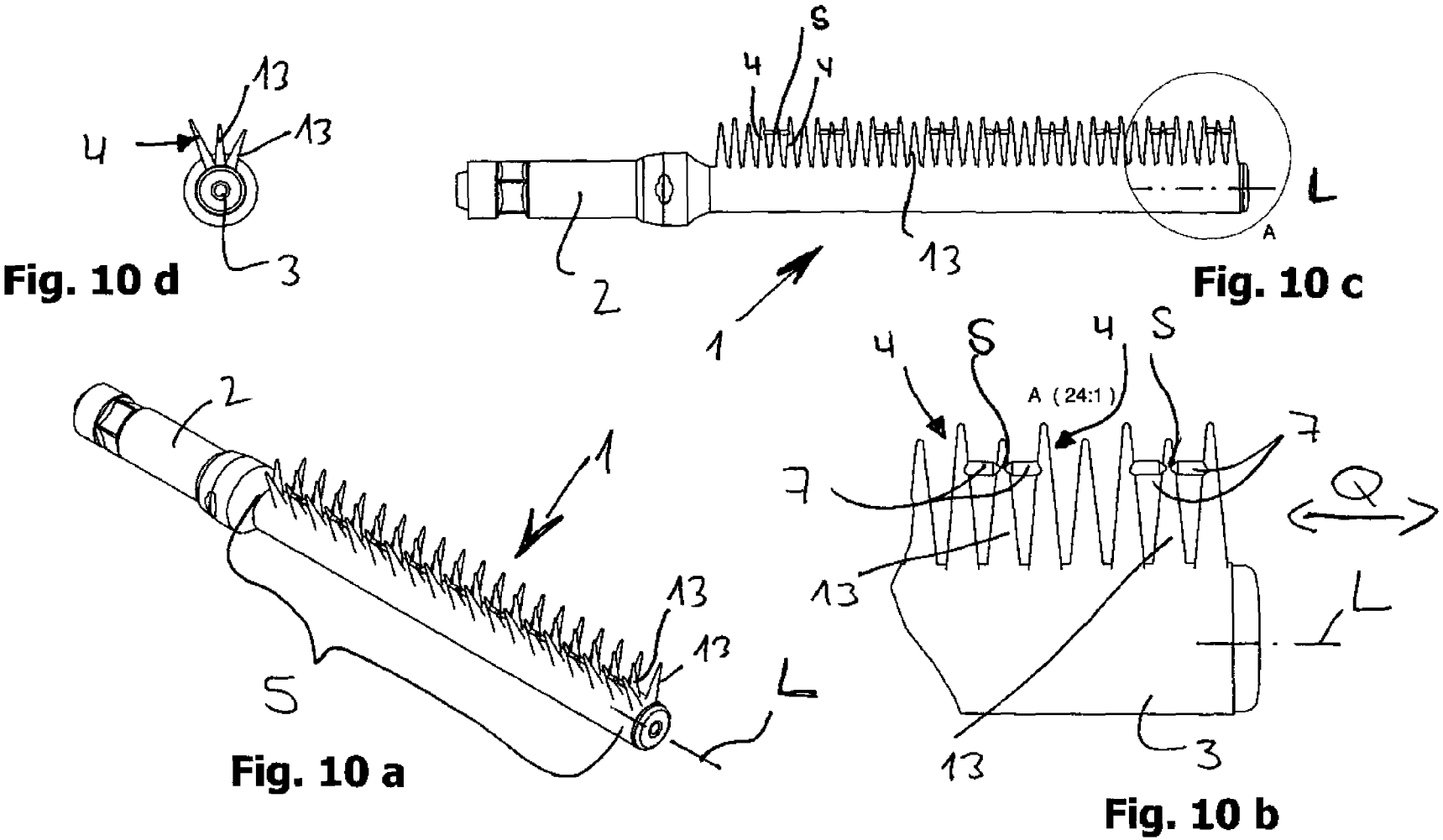
FIGS. 10*a* to 10*d* show a tenth exemplary embodiment of the invention, in which the eyelash retaining organs are configured in the form of a needle eye or a gate, but are modified by a gap.
Figure 11C:
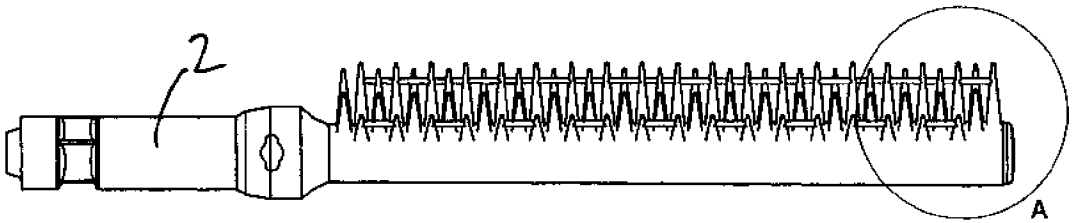
FIGS. 11*a* to 11*d* show a eleventh exemplary embodiment of the invention, in which the eyelash retaining organs are configured in the form of a needle eye or a gate, but are placed differently.
Figure 11B:
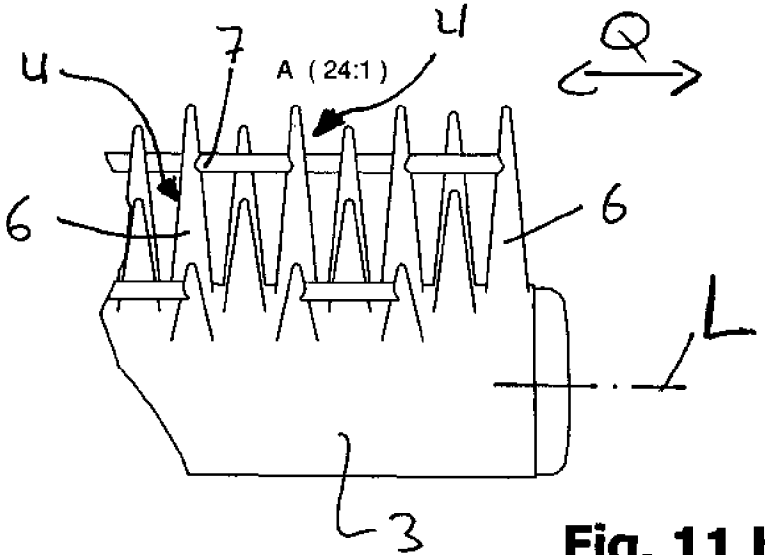
Figure 11D:
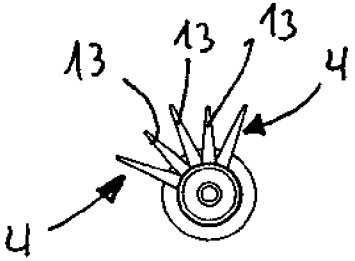
Figure 11A:
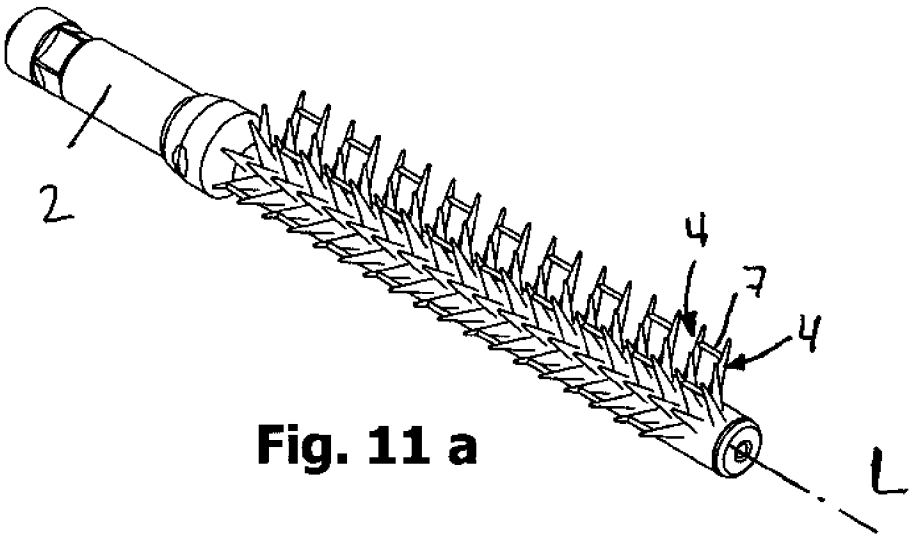

Therefore, the mascara brush is in this case preferably configured such that it is not covered with a bristle area all around, but only over a part of its circumference, so that the bristle area has an edge that can be accessed well, as FIG. 9*d* shows.

The bristle row equipped with the eyelash retaining organ 7 addressed herein forms at least a bristle row forming the boundary of the bristle area. At the same time, this bristle row with the eyelash retaining organs consists of bristles that have a greater length than the other or at least the adjacent bristles of the bristle area. It is thus made easier for the user to thread the eyelashes, from the edge, into the opening of the eyelash retaining organ 7 substantially forming a needle eye, thus subjecting them rather effectively, for example, to a curling or extending/lengthening process.

As a rule, the eyelash retaining organ 7 addressed herein at the same time also improves the wetting of the eyelashes with mascara mass because an additional amount of mascara mass can deposit on the eyelash retaining organ also in this case without being removed by the wiper when the mascara brush is pulled out.

It is to be noted that the needle eye (in the broader sense) formed by the eyelash retaining organ is completely closed in this case only preferably on the distal side—in principle, it is also conceivable that the rod-shaped body forming the eyelash retaining organ 7 has a gap at some place, the gap being so small that it does not jeopardize the above-described function in any substantial manner, but makes it possible, if required, for the eyelashes to be threaded in from the distal side, and not only by a movement in the circumferential direction.

Tenth Exemplary Embodiment

FIGS. 10*a* to 10*d* show a tenth exemplary embodiment, which is characterized by the fact that the eyelash retaining organ used in this exemplary embodiment extends between two adjacent bristles, but is equipped with a gap S, that is, basically consists of two rod-shaped bodies, which respectively project from one of the neighboring bristles and meet in the intermediate space between these two bristles. The gap S can be configured such that it opens only under the influence of the forces acting during the application, or such that it is open from the beginning, in which case it should preferably have a width that is less than 15 diameters of an average eyelash.

Otherwise, however, the tenth exemplary embodiment corresponds to the ninth exemplary embodiment, so that the statements pertaining to the latter also apply to the tenth exemplary embodiment unless otherwise stated below.

Said gap S is produced such that a predetermined breaking area, which then tears open during the use of the mascara brush, thus forming the gap S, is produced at the location at which the gap S is supposed to be available during use. As was already indicated above, an eyelash retaining organ can thus be obtained into which eyelashes can be threaded not only from the tangential direction, but also by a movement in a substantially distal direction.

Eleventh Exemplary Embodiment

FIGS. 11*a* to 11*d* show an eleventh exemplary embodiment. This eleventh exemplary embodiment corresponds to the ninth and the tenth exemplary embodiments and differs, in particular, from the ninth exemplary embodiment only by the fact that, centrally in the bristle area, a bristle row is provided also in this case, which comprises the eyelash retaining organs 7 described for the ninth exemplary embodiment. Therefore, in the circumferential direction, a bristle row with eyelash retaining organs extending in the longitudinal direction and a bristle row with conventional bristles extending in the longitudinal direction are alternately provided in the eleventh embodiment. In this case, the conventional bristles are disposed such that they are located on a meridian which (preferably centrally) extends through the needle eye between two adjacent bristles with a joint eyelash retaining organ.

It should be stated generally that the eyelash retaining means according to the invention in all variations shown herein additionally have the great advantage that a considerable additional amount of mascara mass is deposited on them without there being any danger of the mascara mass dripping off in an undesired manner, which enables a very effective application without the mascara brush having to be charged again several times.

In addition, the eyelash retaining means configured as thickened portions, especially in those areas where a relatively hard material is used for the bristles or where the bristles are not very elastic for other reasons, have the advantage of improving the tactile effect of the mascara brushes—the user no longer has the impression that the bristles "prick" if they are brought too close to the eyelid, and thus automatically brings the mascara closer to the eye, which improves the application effect. The application is thus made easier especially in the case of inexperienced users.

The bristles and bristle areas according to the invention can be produced by means of various methods; the one—and two component technology and the so-called moltrusion are to be given particular mention in this regard; production by metal or ceramic injection molding is also optionally possible.

The invention claimed is:

1. A mascara brush comprising:

a carrier portion and a bristle covering of bristles respectively protruding outwardly along their longitudinal bristle axis L from the carrier portion, wherein the bristle covering comprises bristles consisting essentially of a bristle stem and an eyelash retaining organ adjoining thereto, which is configured as a retaining projection, which projects over the surface of the bristle stem in a direction parallel to the longitudinal bristle axis, wherein the eyelash retaining organ is arrow-shaped with two mutually opposing hook-like appendages that protrude laterally from the bristle stem and, at an outermost end of each appendage, form an angle of less than 70° with a longitidinal axis of the bristle stem;

wherein the bristles of two adjacent bristle rows, relative to the longitudinal bristle axis, are each positioned on a level of a meridian extending centrally through a free space between the eyelash retaining organs of bristles of a center bristle row standing next to each other, while a maximum extension of each eyelash retaining organ, in a longitudinal direction parallel to the longitudinal bristle axis, is so large that one eyelash retaining organ, respectively, overlaps with the closest retaining organs of the adjacent row, if projected onto each other in a circumferential direction, thus ensuring that, from outside the bristle covering, in a radial direction, there are no annular channels that are continuous in the circumferential direction in the bristle area formed by the bristles with the eyelash retaining organs and, instead, such a free space remains only between the bristle stems.

2. The mascara brush according to claim 1, wherein the bristle covering comprises bristles whose eyelash retaining organ is in each case configured such that the eyelash retaining organ is capable of positively reaching over at least one eyelash, such that a slipping off of the eyelash from the bristle concerned along the lateral surface of the bristle towards its longitudinal bristle axis L is impeded.

3. The mascara brush according to claim 1, wherein the respective eyelash retaining organ comprises at least one appendage configured like a barb.

4. The mascara brush according to claim 1, wherein the eyelash retaining organ has a distal surface that inclines inwardly from an area of the eyelash retaining organ lying above a bristle center towards the edges of the eyelash retaining organ, such that the eyelash retaining organ has a tendency to let eyelashes resting on its surface slide off into an intermediate space formed with an adjacent bristle or bristles.

5. The mascara brush according to claim 1, wherein the eyelash retaining organ has a proximal surface which is inclined towards a bristle center, such that the eyelash retaining organ has a tendency to let eyelashes resting on it slide off in a lateral direction towards the bristle center.

6. The mascara brush according to claim 1, wherein the eyelash retaining organs have such a large maximum extension, in a direction transverse to a circumferential direction, that the eyelash retaining organs of a bristle row disposed in the circumferential direction one row behind the other row overlap, viewed in the circumferential direction.

7. The mascara brush according to claim 1, wherein the eyelash retaining organ comprises at least one rod-shaped element that protrudes laterally from a respective bristle.

8. The mascara brush according to claim 1, wherein two bristles, respectively, have a joint eyelash retaining organ configured such that the eyelash retaining organ forms, together with the bristles concerned, an opening, which in a single plane is substantially closed on all sides, into which at least one eyelash can be threaded.

9. A bristle carrier for use in the mascara brush according to claim 1.

10. A mascara product, consisting of a mascara brush, a storage container with a closure cap and a mascara mass, wherein the mascara brush is the mascara brush according to claim 1.

11. A mascara brush comprising:

a carrier portion and a bristle covering of bristles respectively protruding outwardly along their longitudinal bristle axis L from the carrier portion, wherein the bristle covering comprises bristles consisting essentially of a bristle stem and an eyelash retaining organ adjoining thereto, which is configured as a retaining projection, which projects over the surface of the bristle stem in a direction parallel to the longitudinal bristle axis, wherein the eyelash retaining organ comprises at least one rod-shaped element that protrudes laterally from a respective bristle and the rod-shaped element is configured to be so long that it reaches a neighboring bristle or a bar shaped element of a neighboring bristle while forming a gap opening only under the influence of application forces or while forming a gap which, from the beginning, is approximately as wide as 15 average eyelash diameters, wherein said gap is configured such that, through it, at least one eyelash can enter into a free space between the bristles underneath the rod-shaped element.

12. The mascara brush according to claim 11, wherein the gap is formed by a predetermined breaking area where the rod-shaped element, which is at first produced without any gap, breaks when the brush is being used or tears off from a bristle.

13. The mascara brush according to claim 11, wherein the bristles with the gap opening eyelash retaining organs form an outer row of a bristle area freely accessible from one side and the gap openings face the free side.

14. The mascara brush according to claim 8, wherein the bristles with the joint eyelash retaining organs form an outer row of a bristle area freely accessible from one side and the opening face the free side.

15. A mascara brush comprising:

a carrier portion and a bristle covering of bristles respectively protruding outwardly along their longitudinal bristle axis L from the carrier portion, wherein the bristle covering comprises bristles consisting essentially of a bristle stem and an eyelash retaining organ adjoining thereto, which is configured as a retaining projection, which projects over the surface of the bristle stem in a direction parallel to the longitudinal bristle axis, wherein the eyelash retaining organ is formed by two hook-like appendages that can be elastically bent towards a lateral end of the bristle with relative ease while offering sufficiently large resistance to being bent in a distal direction.

16. The mascara brush according to claim 15, wherein the two hook-like appendages form a cavity where they meet in a vicinity of the longitudinal bristle axis, with a pin protruding distally from the cavity.

17. A mascara brush comprising:

a carrier portion and a bristle covering of bristles respectively protruding outwardly along their longitudinal bristle axis L from the carrier portion, wherein the bristle covering comprises bristles consisting essentially of a bristle stem and an eyelash retaining organ adjoining thereto, which is configured as a retaining groove open towards a distal end in an end face of the distal end of a bristle, wherein a width of the retaining groove viewed in a longitudinal direction becomes larger from a distally outermost end in a proximal direction such that the retaining groove has a clamp-like or dovetail-like profile that exerts a retaining action on eyelashes that have inserted themselves into the retaining groove.

18. The mascara brush according to claim 17, further comprising a chicane configured as a cylindrical pin that protrudes from a bottom of the retaining groove.

19. The mascara brush according to claim 17, wherein a cross-sectional area of the bristle stem becomes larger towards a distal end such that the bristle becomes wider in a longitudinal direction.

* * * * *